US007631511B2

(12) United States Patent
Al-Azmi et al.

(10) Patent No.: US 7,631,511 B2
(45) Date of Patent: Dec. 15, 2009

(54) PORTABLE AIR CONDITIONING AND WATER COOLING APPARATUS

(76) Inventors: Eid Al-Azmi, Block 6, Street 4-House 54, Dhaher (KW); Ibrahim Al-Ajmi, Block 4, Street 2, House 32, Al-Reqqa (KW); Talal Al-Otaibi, Block 2, St-3, House 11, Al-Reqqa (KW); Mishal Al-Ajmi, Block 4, St-6. House 53, Mubarak Al-Kabeer (KW)

( * ) Notice: Subject to any disclaimer, the term of this patent is extended or adjusted under 35 U.S.C. 154(b) by 355 days.

(21) Appl. No.: 11/463,043

(22) Filed: Aug. 8, 2006

(65) Prior Publication Data

US 2008/0034770 A1 Feb. 14, 2008

(51) Int. Cl.
*F25B 5/00* (2006.01)

(52) U.S. Cl. ..... 62/199; 62/200; 62/239; 62/331; 62/332; 62/389; 62/394

(58) Field of Classification Search ..... 62/199, 62/200, 389, 394, 331, 332, 239; 222/146.1, 222/146.6

See application file for complete search history.

(56) References Cited

U.S. PATENT DOCUMENTS 3,898,856 A * 8/1975 Komedera ..... 62/98
5,272,884 A * 12/1993 Cur et al. ..... 62/199
5,497,918 A * 3/1996 Brilanchik ..... 222/626
6,182,453 B1 * 2/2001 Forsberg ..... 62/125
6,241,496 B1 * 6/2001 Kim et al. ..... 418/63
6,821,088 B2 * 11/2004 Sakai et al. ..... 415/204
2002/0189279 A1 * 12/2002 Pfister et al. ..... 62/497
2003/0154736 A1 * 8/2003 Lloyd et al. ..... 62/291
2004/0206109 A1 * 10/2004 Nishiwaki et al. ..... 62/468
2005/0139552 A1 * 6/2005 Forsberg et al. ..... 210/748
2005/0219812 A1 * 10/2005 Strobel ..... 361/687
2006/0059922 A1 * 3/2006 Anderson et al. ..... 62/93

* cited by examiner

*Primary Examiner*—Frantz F Jules
*Assistant Examiner*—Daniel C Comings
(74) *Attorney, Agent, or Firm*—Lowe Hauptman Ham & Berner, LLP

(57) ABSTRACT

A portable air conditioning and water-cooling unit includes a mass of refrigerant and a compressor for compressing the refrigerant. The unit also includes a single condenser for condensing the refrigerant and a pipe connecting the compressor and condenser. First and second capillary tubes and first and second connectors connect the first capillary tube to the condenser and a second connector connects the second capillary tube to the condenser. In addition, the unit includes an air conditioning evaporator and a pipe for connecting the air conditioning evaporator to the first capillary tube for cooling air. A water supply is also provided as well as a water-cooling evaporator and pipe connecting the water-cooling evaporator to the second capillary tube. A first thermostat senses the temperature of the water and sends a signal to a solenoid valve for stopping the flow of refrigerant to the second capillary tube when the water reaches a pre-selected temperature. The entire cooling load is directed to the A/C evaporator when the surrounding area reaches a pre-selected temperature. A second thermostat sends a signal to the compressor to shut it off.

1 Claim, 1 Drawing Sheet

PORTABLE AIR CONDITIONING AND WATER COOLING APPARATUS

FIELD OF THE INVENTION

This invention relates to a portable air conditioning and water cooling apparatus and more particularly to an air conditioning and water cooling apparatus that simultaneously cools surrounding air and a supply of cold water.

BACKGROUND FOR THE INVENTION

Air conditioning apparatus for isolated spaces are known. For example, a United States Patent Application Publication of Shahbaz No. 2003/0205055 discloses an air conditioning apparatus for isolated spaces. The apparatus includes a hollow tubular-shaped enclosure which has an elongated box-like shape. The enclosure has a transversely disposed inlet opening, a transversely disposed outlet opening, and fan for drawing air through the enclosure from the inlet side, the air being expelled from an outlet port in the outlet opening of the enclosure. The enclosure also includes an air filter, at least one evaporator connected to a refrigerant compressor and refrigerant-to-water heat exchanger/condenser, and an evaporative cooler assembly including a plurality of nozzles for converting water supply under pressure to the nozzles to fine spray. Water supplied to and warmed by thermal contact with pressurized refrigerant in the water heat exchanger, as well as access water spray which does not evaporate is discharged to a location exterior to the enclosed space such as a sewer drain, thus dumping heat energy to an exterior location. An earlier published patent application of Shahbaz No. 2003/0024261 discloses an integrated system to filter air, humidify air, cool air, cool drinking water, cool air and heat water with a single compressor.

Notwithstanding the above, it is presently believed that there may be commercial market for a portable air conditioning and water-cooling apparatus or unit according to the present invention. There should be a market for such units, which produce both air conditioning and cold water simultaneously and which are designed for small rooms, small tents and other project areas as for example in desert like environments. Further the units are portable, relatively small, and relatively easy to service and can be manufactured and sold at a competitive price. The units are also believed to be efficient in operation and relatively fast in lowering the temperature of a small room, tent or the like. Advantageously, the units in accordance with the present invention combine two functions i.e. air conditioning and cooling water, are smart in appearance of small size and highly mobile. The units combine two evaporators in a single stage vapor compression refrigerant cycle, which consists of one compressor, one condenser, two evaporators, a fan, two capillary tubes and one solenoid valve fixed before the water core evaporator. A thinned-tube evaporator works for the air conditioner cycle while a shell and core evaporator is used for the water cooler. The unit operates on dividing the cooling capacity between the air conditioning evaporator and the water cooler evaporator and when the water reaches the desired temperature as for example 8° C. the thermostat sends a signal to the solenoid valve to close the refrigerant flow. Then all cooling capacity will be directed to the air conditioning evaporator. In this way, the mass flow rate will be increased. Then, the velocity of the flow is increased which decreases the transient time. When the room reaches the desired temperature as for example 18° C. the thermostat will send a signal to the compressor to stop. After that, only the fan will be operating in the unit.

BRIEF SUMMARY OF THE INVENTION

In essence the present invention contemplates a portable air conditioning and water cooling unit that cools air and cold water simultaneously. The unit includes a mass of refrigerant such as the commonly available R-22 and a compressor for compressing the refrigerant. The unit also includes a single condenser for condensing the refrigerant and a pipe connecting the compressor and the condenser so that compressed refrigerant flows out of the compressor and into the condenser to be condensed. First and second capillary tubes and first and second connecting means such as gas conduits or pipes are also provided. The first connecting means connect the first capillary tube to the condenser and the second connecting means connects the second capillary tube to the condenser for reducing the pressure of the refrigerant. In addition, the unit includes a first air conditioning evaporator and third connecting means for connecting the first air conditioning evaporator to the first capillary tube for cooling the air. In a preferred embodiment of the invention the unit includes a water supply, water cooling evaporator and fourth connecting means connecting the water cooling evaporator to the second capillary tube for receiving refrigerant after cooling water from the water supply. A thermostat senses the temperature of the water and a solenoid valve stops the flow of refrigerant to the second capillary tube to thereby direct all of the flow of refrigerant to the first capillary tube when the supply of water reaches a pre-selected temperature. A second thermostat may also be provided for shutting down or turning off the unit when the air has reached a second pre-selected temperature. The invention will now be described in connection the following figures.

DESCRIPTION OF THE PREFERRED EMBODIMENTS OF THE INVENTION

Figure 1:
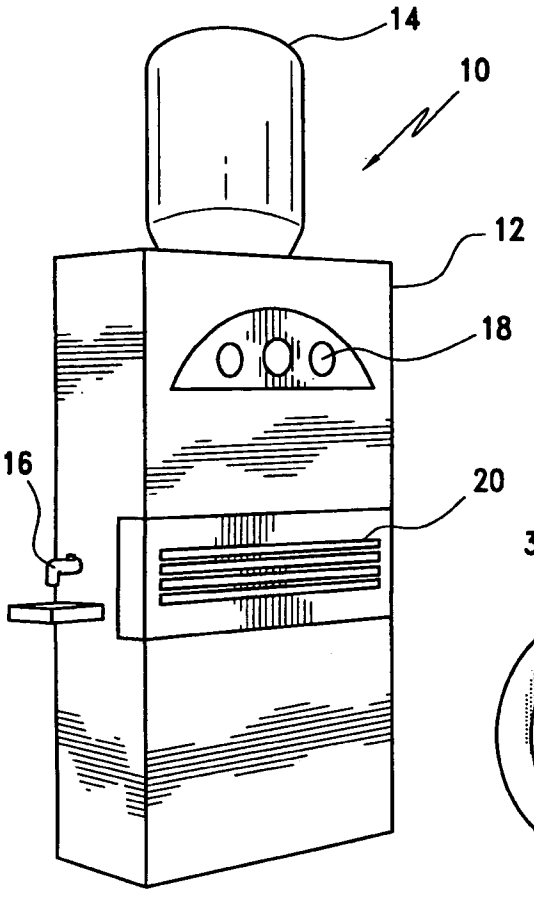
FIG. 1 is a perspective view of an air conditioning and water cooling unit in accordance with the present invention.

A portable air conditioning unit and water-cooling apparatus or unit 10 in accordance with the first embodiment of the invention is illustrated in FIG. 1. As illustrated, the portable air conditioning and water-cooling unit 10 is incorporated in a relatively small housing 12 with a pleasing and familiar appearance that is generally similar to and about the same size as a conventional water cooler.

The unit 10 includes a water tank 14 shown for convenience on top of the unit 10, but which may be installed on the inside of the housing 12. As illustrated, a water faucet 16 extends outwardly from one side of the housing, but which may be installed in the front or other convenient location in a housing or cabinet. An air intake in the bottom backside of the housing 12 while cooled air exits the unit 10 through a vent 20. The unit 10 also includes a power cord for connection to a source of electricity, an exhaust duct for venting heated air and wheels for moving the unit about are not shown in FIG. 1.

The units in accordance with the present invention are designed for air conditioning areas that need fresh cool air and cold water such as small tents, small offices or office trailers in areas that require cool air and water. The main purpose of the unit is also designed to combine the two functions into one system by using two evaporators, one for air conditioning and the other for cooling water with a single compressor and single condenser. In other words the unit uses one refrigeration cycle, which divides the cooling capacity into two sub-assemblies i.e., air conditioning and water-cooling by using a single compressor. In this way, the units are relatively inexpensive, of relatively small size, lightweight and easily moved from one place to another. The units also incorporate a number of features, which contribute to their desirability. For example, a one-piece package contains air conditioner or cooler. It is simple and easy to operate, relatively light weight and occupies a small area. In addition, there is low power consumption because of using one device to produce the air conditioning and cooled water. However, the system may be powered from most sources of power supply such as those of 120/240 volts, a generator or the like. A further advantage resides in the use of a low sound built-in rotary compressor and a centrifugal blower fan, which reduces noise inside the room. A portable storage water tank is provided and a heat exhaust hose to let the hot air exhaust to the outside of the area.

Figure 2:
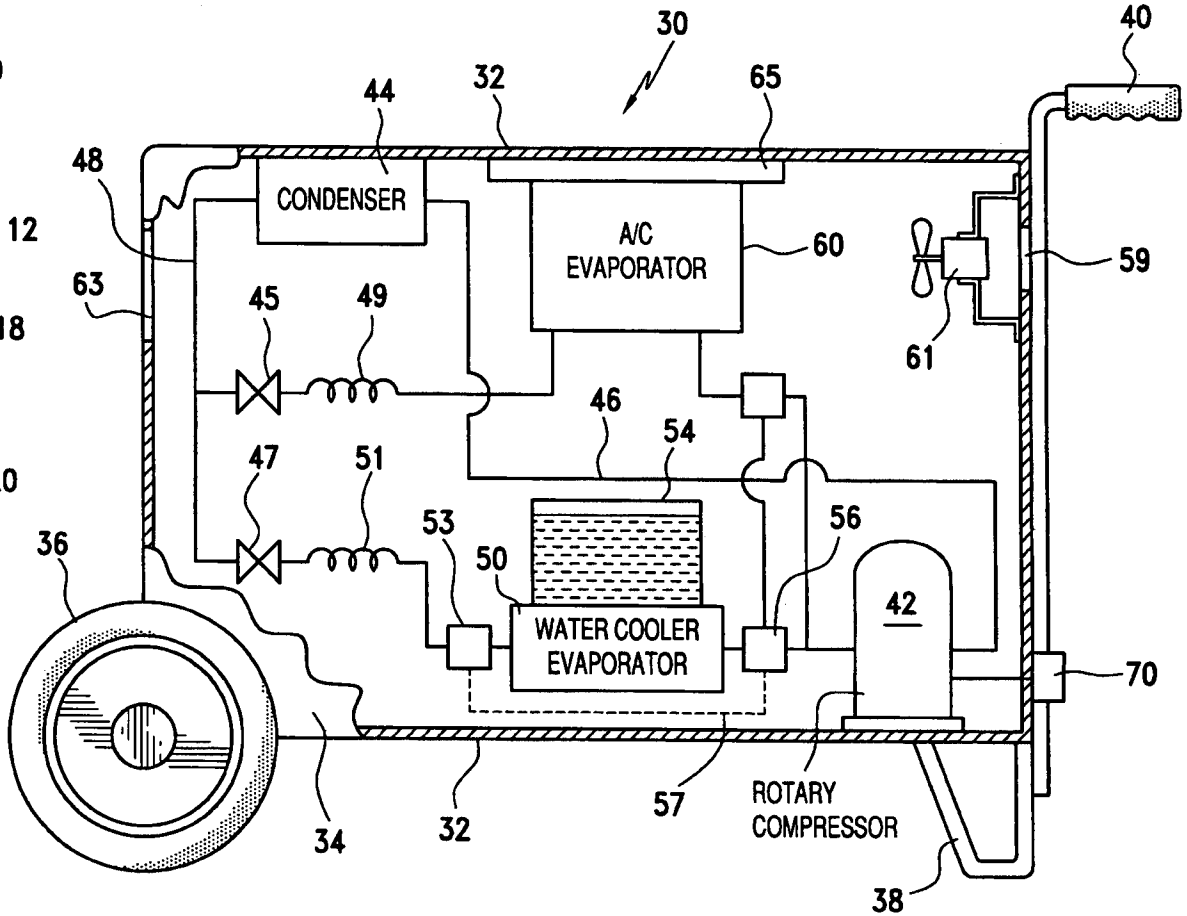
FIG. 2 is a schematic illustration of an air conditioning and water cooling unit in accordance with a second embodiment of the invention.

A second embodiment of the invention is illustrated in FIG. 2 wherein a portable unit 30 includes a cart-like structure having a frame 32 and a housing 34. The unit 10 is mounted on wheels 36 (only one of which is shown) and includes a front support 38 and handle 40 of conventional design. The cart-like structure carries the air conditioning and water-cooling apparatus, which includes a single compressor 42 for compressing a mass of refrigerant such as R-22, a single condenser 44 and a pipe 46 connecting the compressor 42 and condenser 44.

The compressor 42 moves the refrigerant in the cycle, forcing the refrigerant into a condenser 44 and gas conduit or pipe 48 and then to an evaporator 50. A hermetic rotary compressor is preferable. The compressor is designed to use refrigerant R-22 at low evaporating temperatures. Further, rotary compressors are designed by optimizing the three critical elements of high efficiency and high performance. For example, extremely close tolerances are maintained between moving parts resulting in high compressed volumetric efficiency. Mechanical losses due to vibration and friction are minimized due to a precision machining, ultra smooth finishes on moving parts. Gas flow losses and operating sound levels are minimized by designing a gas-circulating route that helps assure smooth flow through the rotary cycle. The rotary compressor also incorporates a high performance, high efficiency motor that was integrated with the above design features to result in a quiet high efficiency low operating cost compressor.

In the present invention, the design concepts incorporate a refrigerant cycle consisting of one compressor, one condenser, two evaporators, two capillary tubes, one solenoid valve and two thermostats; one for air conditioning and one for the water cooler. In the operation of the device, the compressor compresses the refrigerant and delivers the refrigerant through a pipe and into a condenser. Then, by using a two-way valve, which is welded to the outlet of the condenser, it divides the refrigerant into two one-way valves; one for an air conditioning evaporator and the other for the water cooler apparatus. The refrigerant passes through two capillary tubes that are welded to the two-way valve and connects to the two-evaporator inlets. The capillary tubes are designed based on the cooling capacity for each evaporator and are used to control the refrigerant according to the cooling capacity. For example, when the water reaches the desired temperature, the solenoid valve connected to a water evaporator is closed so that all of the refrigerant will go to the evaporator of the air conditioner.

In the second embodiment of the invention, an output of the single compressor 42 is connected to an input of a single condenser 44 by a pipe or gas conduit 46. The condenser 44 also includes a refrigerant output, which is connected to two one-way valves 45 and 47 by a gas conduit or pipe 48. The valves 45 and 47 are connected to two capillary tubes 49 and 51 respectively. One of the capillary tubes 51 is in turn connected to a coil water cooler evaporator 50 through a solenoid actuated valve 53.

An electrically operated shut off valve is required for the refrigerant circle. These valves take the form of a plunger operated by a solenoid and work directly on the valve orifice or through a servo. The usual arrangement is to energize the solenoid to open the valve and de-energize the solenoid to close the valve. In the practice of the present invention, a solenoid valve with a ¼ inch bore was used in front of the water cooler evaporator 50.

A water cooler thermostat 56 is used to control the cold-water temperature in a water tank 54. For example, when the water reaches 8° C., the thermostat sends a signal over a line 57 to the solenoid valve 53 to cut off the flow of the refrigerant to the water cooler evaporator to thereby force the entire mass of the refrigerant to and through an AC evaporator 60 of a finned tube design.

The finned tube AC evaporator 60 receives refrigerant from the capillary tube 49 for cooling air. For example, air is drawn into the cabinet or housing through an opening 59 by a centrifugal fan 61 and exits from the cabinet through an opening 63. A flexible hose (not shown) is used to duct the hot air out of the room or area. Cold air is pumped out into the surrounding area through a vent 65 in a conventional manner. A thermostat 70 senses the ambient temperature outside of the cabinet and when the temperature reaches a pre-selected temperature, as for example 24° C. it sends a signal to turn off the compressor and shut down the unit. Nevertheless, for some units and in some areas the fan will be allowed to continue to run.

The design concept for the present invention incorporates a refrigeration cycle consisting of one compressor, one condenser, two evaporators, two capillary tubes, one solenoid valve and two thermostats; one for air conditioning and one for the water cooler. In the operation of the device, the compressor compresses the refrigerant into the condenser and then by using a two-way valve which is welded to the outlet of the condenser, it divides the refrigerant into two one-way valves; one for the air conditioner evaporator the other for the water cooler evaporator. The refrigerant passes through two capillary tubes that are welded to the two one-way valves and connected to the two-evaporator inlets. The capillary tubes are designed based on the cooling capacity for each evaporator and are used to control the refrigerant according to the cooling capacity. When the water reaches the desired temperature, the solenoid valve is connected to a water evaporator that controls the refrigerant and prevents it from entering the evaporator or the water cooler. Therefore, all of the refrigerant will be passed to the air conditioner.

In a preferred embodiment of the invention, a ¾ horse power rotary compressor is used and the cooling load is divided into 2,000 BTU for the water cooler and 7,000 BTU for air conditioning Electrical circuits are of a conventional design but includes a main control switch i.e. an on off switch, an air conditioning switch and both water cooler and AC switches. A mode selector switch is used in the air conditioning unit as two functions, the first being when a cool mode is selected, the compressor will work to feed the evaporator of the air conditioning unit and the evaporator of the water cooler. When the room reaches the desired temperature before the water, the compressor will stop and only the fan will work. However, if more time is required to reach the desired air temperature when the temperature of the air reaches the desired temperature the water will be cold enough. The fan has two speeds so that an individual can control the speed of the fan manually In the refrigeration cycle, the temperature is designed to reach 8° C. for water cooler and 18 to 24° C. for air conditioning. A suitable thermostat control is used. The cooling capacity in the cycle has 9,000 BTU/per hour and is divided between 7,000 BTU per hour for the AC evaporator and 2,000 BTU/per hour for the water cooler. The capillary tubes before each evaporator controls a pressure and flow rate.

What is claimed is:

1. A portable air conditioning and water-cooling unit that cools air and water simultaneously, said apparatus consisting of:

a cart having wheels, a frame and a housing mounted on said wheels, a front support and a handle;

a first opening and a second opening in said housing for allowing air into and out of said housing, a duct for directing hot air out of a room or area and a vent for releasing cooled air into the surrounding area;

refrigeration means including a mass of R-22 refrigerant and a single hermetic rotary compressor having an inlet for compressing the refrigerant, a single condenser for condensing the refrigerant and a pipe connecting said compressor to said condenser so that compressed refrigerant flows out of said compressor and into said condenser to be condensed thereby;

first and second capillary tubes and first and second connecting means, said first connecting means connecting said first capillary tube to said condenser for reducing pressure of the refrigerant and said second connecting means connecting said second capillary tube to said condenser for reducing pressure of said refrigerant therein;

an air conditioning thin tube evaporator and third connecting means connecting said air conditioning thin tube evaporator to said first capillary tube for cooling air and wherein said air conditioning thin tube evaporator includes an outlet;

a first pipe for connecting the outlet of said air conditioning thin tube evaporator to said inlet of said rotary compressor;

a supply of water, a water cooling evaporator and fourth connecting means connecting said water cooling evaporator to said second capillary tube for receiving the refrigerant therefrom and for cooling water from said supply of water, and wherein said water cooling evaporator includes an outlet;

a second pipe for connecting said outlet of said water cooling evaporator to said inlet of said rotary compressor;

a first thermostat for sensing the temperature of water and a solenoid valve activated by said thermostat for stopping the flow of refrigerant to said second capillary tube to thereby direct all of the flow of the refrigerant to said first capillary tube when the supply of water reaches a pre-selected temperature;

a second thermostat and means for shutting off said compressor when the surrounding air reaches a pre-selected temperature;

a centrifugal blower fan for circulating air through the unit for cooling the air conditioning evaporator; and in which the water cooler evaporator is a shell and coil heat exchanger.

* * * * *